US006652210B1

(12) United States Patent
Yeaple

(10) Patent No.: US 6,652,210 B1
(45) Date of Patent: Nov. 25, 2003

(54) INDIVIDUAL BOOK-BINDING SYSTEM AND METHOD

(75) Inventor: Ronald N. Yeaple, Winter Park, FL (US)

(73) Assignee: Yeaple Corporation, New Smyrna Beach, FL (US)

( * ) Notice: Subject to any disclaimer, the term of this patent is extended or adjusted under 35 U.S.C. 154(b) by 15 days.

(21) Appl. No.: 09/594,246

(22) Filed: Jun. 15, 2000

Related U.S. Application Data

(60) Provisional application No. 60/184,989, filed on Feb. 25, 2000.

(51) Int. Cl.[7] ..... B42C 9/00

(52) U.S. Cl. ..... 412/37; 412/6; 412/8; 412/28; 412/32; 412/33; 412/34; 412/900; 412/902

(58) Field of Search ..... 412/6, 8, 28, 32, 412/33, 34, 900, 902, 37

(56) References Cited

U.S. PATENT DOCUMENTS

| | | | | |
|---|---|---|---|---|
| 3,717,366 A | | 2/1973 | Decker | |
| 4,077,078 A | | 3/1978 | Snellman et al. | |
| 4,108,713 A | * | 8/1978 | Weisz | 156/499 |
| 4,141,100 A | * | 2/1979 | Domroe et al. | 412/37 |
| 4,289,330 A | | 9/1981 | Wiermanski | |
| 4,855,573 A | | 8/1989 | Vercillo et al. | |
| 4,898,506 A | * | 2/1990 | Lazar | 412/8 |
| 5,120,176 A | | 6/1992 | Bhatia et al. | |
| 5,156,510 A | | 10/1992 | Uehara | |
| 5,256,859 A | | 10/1993 | Nanos et al. | |
| 5,275,520 A | | 1/1994 | Yano et al. | |
| 5,314,283 A | * | 5/1994 | Zoltner | 412/33 |
| 5,340,155 A | | 8/1994 | Podosek | |
| 5,454,680 A | * | 10/1995 | Lazar | 412/41 |
| 5,465,213 A | | 11/1995 | Ross | |
| 5,829,938 A | | 11/1998 | Hartwig et al. | |
| 5,833,423 A | | 11/1998 | Yamaguchi et al. | |
| 6,508,881 B1 | * | 1/2003 | Muller et al. | 118/663 |
| 2002/0064437 A1 | * | 5/2002 | Kuramoto et al. | 412/37 |
| 2003/0063963 A1 | * | 4/2003 | Kuramoto et al. | 412/37 |

FOREIGN PATENT DOCUMENTS

| | | |
|---|---|---|
| EP | 0 334 260 | 3/1989 |
| EP | 0 334 261 | 3/1989 |
| EP | 0 481 633 | 4/1992 |
| FR | 2 546 822 | 12/1984 |

* cited by examiner

*Primary Examiner*—A. L. Wellington
*Assistant Examiner*—Mark T. Henderson
(74) *Attorney, Agent, or Firm*—Allen, Dyer, Doppelt, Milbrath & Gilchrist, P.A.

(57) ABSTRACT

A stack of pages is bound along a first edge thereof to form a book using an adhesive having a melting temperature and an elongated strip having an adhesive atop at least a portion of a first side. The strip has two opposed ends and an electrical resistivity between the ends and is dimensioned to substantially cover the first edge of the stack, with the first side against the first edge of the stack. An electrical current is introduced to pass along the strip between the ends. The current should be sufficient to create enough heat in the strip to achieve a temperature at least as great as the melting temperature, enabling the melted adhesive to bind the stack of pages together along the first edge. Apparatus are also provided for supporting, holding, and clamping the page stack prior to and during the binding process.

31 Claims, 11 Drawing Sheets

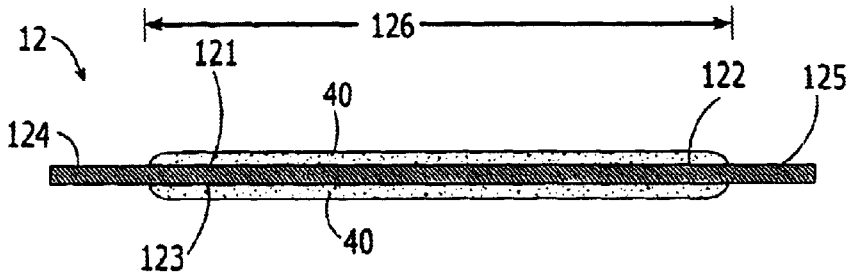
FIG. 1.
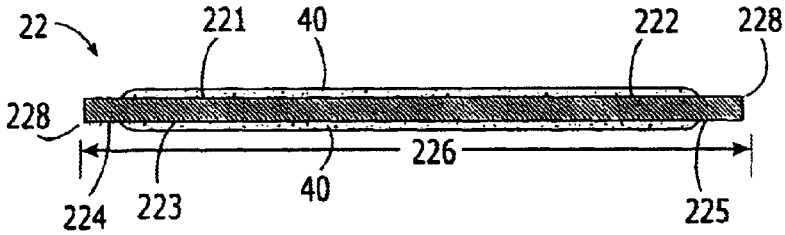
FIG. 2.
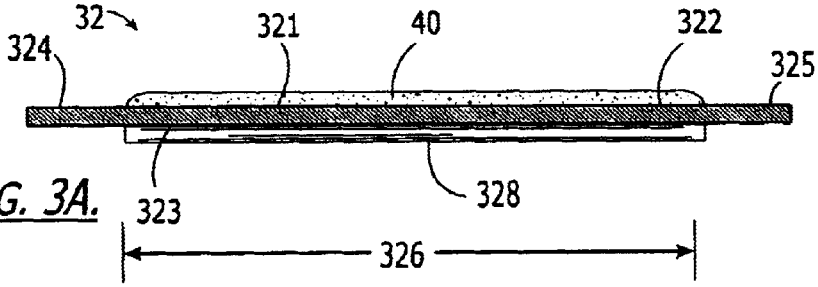
FIG. 3A.
FIG. 3B.
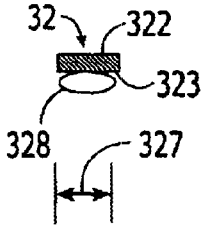
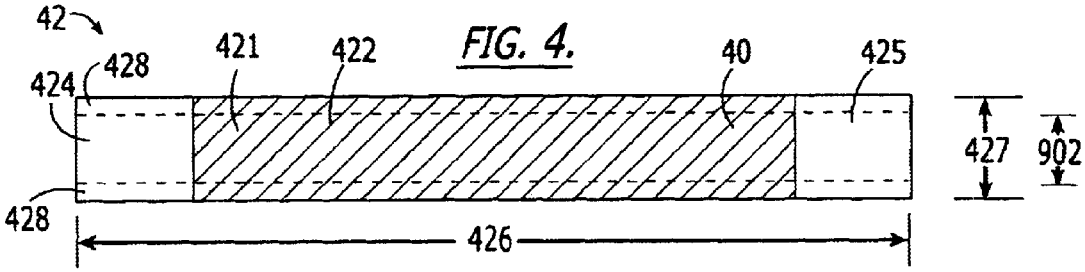
FIG. 4.
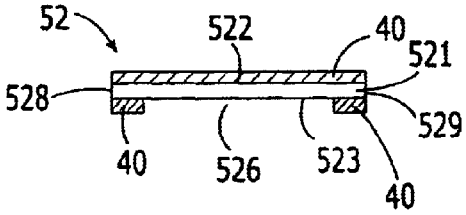
FIG. 5.

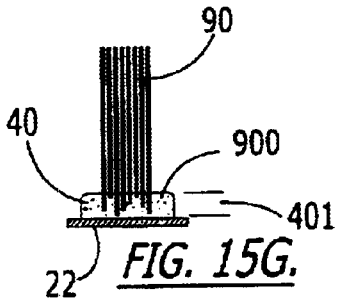
FIG. 15G.
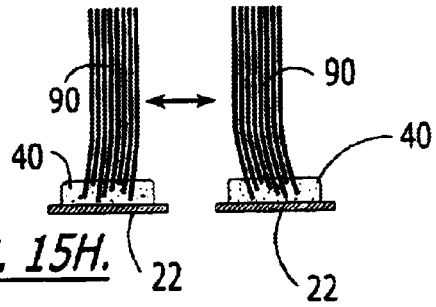
FIG. 15H.
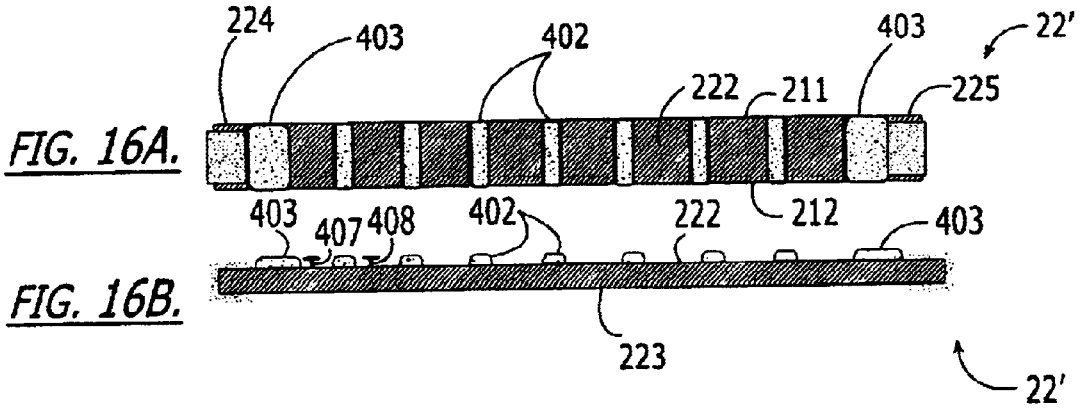
FIG. 16A.
FIG. 16B.
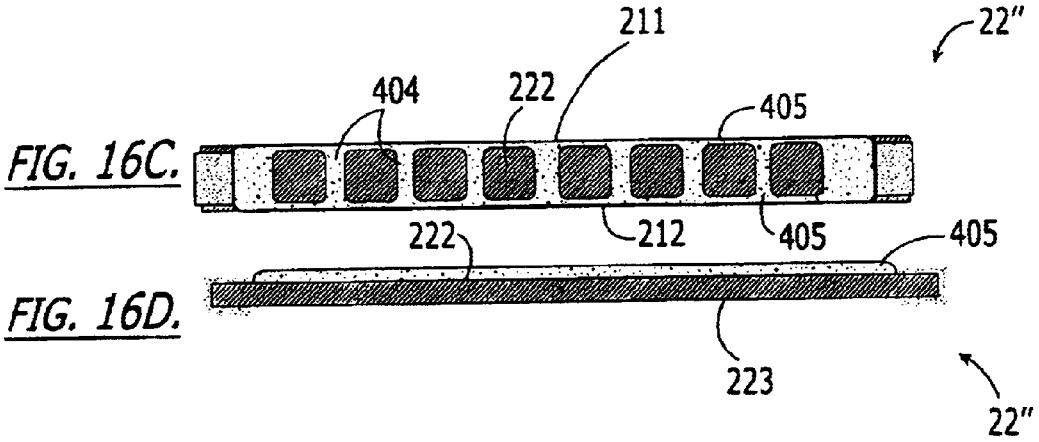
FIG. 16C.
FIG. 16D.

INDIVIDUAL BOOK-BINDING SYSTEM AND METHOD

CROSS REFERENCE TO RELATED APPLICATION

The present application claim priority to and incorporates by reference U.S. Provisional Application Serial No. 60/184,989, filed Feb. 25, 2000, which is commonly owned and assigned with the present application.

BACKGROUND OF THE INVENTION

1. Field of the Invention

The present invention relates to systems and methods for binding pages together, and, more particularly, to such systems and methods for binding individual books.

2. Description of Related Art

A variety of different techniques are known for binding books. At one end of the spectrum is the so-called perfect binding technique used for paperback books. Individual page sheets are bound directly to the inside of the spine of the cardboard cover using a hot-melt adhesive that is solid at room temperature. Perfect binding is suitable for paperback books produced in large quantities. The high-volume machines used for perfect binding are very large and costly and must be set up for each run of books, a time-consuming process which often results in making trial copies that must be discarded. High-volume perfect binding machines are not practical for running single copies of books such as those downloaded from the Internet.

Thermal tape is another means for binding books and is often employed as a finishing operation for high volume xerographic duplicators. The pages are individual sheets, usually 8½×11 inches, and the covers are cardboard sheets of the same size as the pages. Paper tape coated on one side with hot-melt adhesive forms the spine of the book and the adhesive is activated as it passes over heated surfaces inside the machine. It is difficult to print the title and author's name on the spine unless pasted on in a separate label. While thermal tape is a convenient method for binding small lots of booklets such college course packs, such booklets do not offer the aesthetic appeal of high quality bound volumes.

There are various other means for binding small quantities of books using staples, plastic combs, wire spirals, and plastic posts, none of which provide the look and feel of a fine bound volume.

A preferred method for binding books is the traditional cloth binding technique used for hardcover books. The pages are printed on large sheets called signatures, which are then folded, sewed and glued together, and then trimmed. The cover consists of front and back cardboard pieces encased in decorative cloth binding material, which also forms the hinges and outer spine. Cloth binding has advantages of quality appearance, durability, and ease of page turning, since the pages are glued to a flexible inner cloth spine that is fastened to the outer spine only at its edges. Like perfect binding, cloth binding is a high-volume process involving the use of large and costly machines, and is therefore not suitable for binding single copies. There are a few craftsmen who specialize in custom binding or repairing single cloth bound books, but such work is highly skilled and expensive.

At the high end of the spectrum are leather bound books. Produced by a process similar to cloth binding, leather bound books offer the ultimate in luxurious appearance.

It is known in the art to heat a hot-melt adhesive onto page edges to bind a book with an external heater (Decker, U.S. Pat. No. 3,717,366; Snellmann et al., U.S. Pat. No. 4,077,078; Wiermanski, U.S. Pat. No. 4,289,330; Uehara, U.S. Pat. No. 5,156,510; Podosek, U.S. Pat. No. 5,340,155; Hartwig et al., U.S. Pat. No. 5,829,938; Yamaguchi et al., U.S. Pat. No. 5,833,423). It is also known to heat a hot-melt adhesive coated on an electrically resistive layer applied to the inner surface of a report binder (Vercillo et al., U.S. Pat. No. 4,855,573; Akopian, FR 2,546,822) with the use of a power supply (Nanos et al., U.S. Pat. No. 5,256,859).

It is also known to use a microwave-activatable adhesive to bind books, with the adhesive placed between a sheaf of papers and the binder (Bhatia et al., U.S. Pat. No. 5,120,176).

Additionally, it is known to employ individual book-binding apparatus following the printing of a book from a storage medium such as a database (Ross, U.S. Pat. No. 5,465,213).

SUMMARY OF THE INVENTION

It is therefore an object of the present invention to provide a system and method for binding an individual book.

It is an additional object to provide such a system and method that can create a book with a plurality of cover types.

It is a further object to provide such a system and method that can create a book having a desired shape of the front and rear page surface.

It is another object to provide such a system and method that can create a paperback book having superior page-turning properties.

It is yet an additional object to provide such a system and method that can create a book having a reinforced binding for improved durability.

It is yet a further object to provide such a system and method for producing a bound book having superior aesthetic qualities.

It is yet another object to provide a system and method capable of accommodating tolerances in page dimensions while achieving a secure binding.

These objects and others are attained by the present invention, a system and method for binding a stack of pages along a first edge thereof to form a book. The system comprises an adhesive having a melting temperature and an elongated strip coated on at least a portion of a first side with the adhesive. The strip has two opposed ends and an electrical resistivity between the ends. The strip is dimensioned to substantially cover the first edge of the stack, with the first side against the first edge of the stack.

The system additionally comprises means for introducing an electrical current to pass along the strip between the ends. The current should be sufficient to create enough heat in the strip to achieve a temperature at least as great as the melting temperature of the adhesive. This enables melting the adhesive to bind the stack of pages together along the first edge.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

BRIEF DESCRIPTION OF THE DRAWINGS

FIG. 1 is a side-edge view of a first embodiment of the elongated strip.

FIG. 2 is a side-edge view of a second embodiment of the elongated strip.

FIG. 3A is a side-edge view of a third embodiment of the elongated strip; FIG. 3B is an end view of the embodiment of FIG. 3A.

FIG. 4 is a top plan view of a fourth embodiment of the elongated strip.

FIG. 5 is an end view of a fifth embodiment of the elongated strip.

FIGS. 15A–15H illustrate a clamping device and method of use: a clamping device (FIG. 15A); configuration of the page stack and a cover and strip (FIG. 15B); positioning of cover into clamping device (FIG. 15C); insertion of page stack into the cover and application of current and pressure (FIG. 15D); cross section of clamping device jaws (FIG. 15E); cross section of jaws holding cover and page stack (FIG. 15F); cross section of pages illustrating the accommodation of irregular page edges (FIG. 15G); and the use of a "scrubbing" motion during assembly (FIG. 15H).

FIGS. 16A–16D illustrate top plan (FIGS. 16A, 16C) and side (FIGS. 16B, 16D) views of two exemplary alternate adhesive patterns on a resistive strip.

DETAILED DESCRIPTION OF THE PREFERRED EMBODIMENTS

Figure 6:
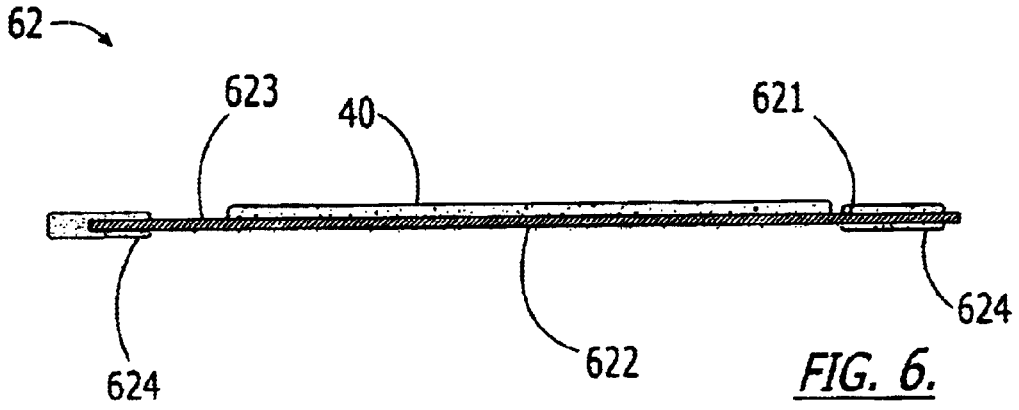
FIG. 6 is a side-edge view of a sixth embodiment of the elongated strip.
Figure 7:
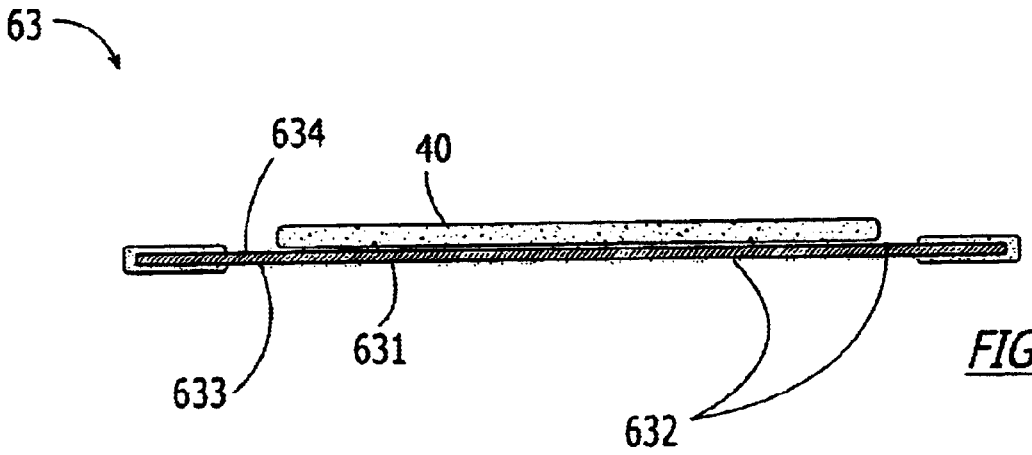
FIG. 7 is a side-edge view of a seventh embodiment of the elongated strip.

A description of the preferred embodiments of the present invention will now be presented with reference to FIGS. 1–18C.

In the present invention, the term "book" may comprise any desired collection of individual sheets that are desired to be bound together, and should not be taken as a limitation. Typically all the pages will be of substantially the same size, at least along the edge to be bound.

The invention is contemplated for use in such applications as binding a stack of pages that have been printed from another source, such as a download from a remote location (e.g., a site on the Internet) or a storage medium such as a disk. However, this application is not intended as a limitation, and one of skill in the art will understand that the invention may be used in any binding situation.

The present invention is generally directed to the binding of books wherein electric current is used to melt adhesive positioned adjacent the page stack edge desired to be bound in a hot-melt binder. The hot-melt adhesive is supplied in solid form, precoated on or impregnated in an electrically resistive strip. In use, the width of the adhesive strip is first trimmed to the approximate thickness of the page stack of the book, such as using ordinary office shears or a paper cutter. Similarly, the length of the strip is trimmed to the approximate length of the page stack plus an amount desired to extend therebeyond. Alternatively, various precut widths and lengths of strips may be supplied to a consumer or vendor for subsequent purchase by a customer.

Seven exemplary embodiments of the adhesive-coated flexible elongated strip of the present invention are illustrated in FIGS. 1–7. In all the cases contemplated in the preferred embodiments, the strip has an electrical resistivity and is coated or impregnated on at least a first side with a solidified hot-melt adhesive, permitting an electrical current passing therethrough to generate heat in the strip and to melt the adhesive.

The resistive strip may comprise any of a number of materials known in the art, preferably a flexible material in order to impart flexibility to the binding. The material may be selected from a group consisting of metal foil or mesh; conductive inks, foils, paints, or layers printed, coated, or vacuum deposited on a paper, cloth, plastic, or another substrate; or from woven or nonwoven carbon-fiber material.

A best mode of this invention, as believed at the present time, comprises the use of woven carbon-fiber cloth for the resistive strip, although it will be understood by one of skill in the art that other materials such as those described above might also serve.

Carbon-fiber composites are known for their strength, light weight, and electrical conductivity. Carbon-fiber cloth impregnated with hot-melt adhesive has many advantages for the present invention. As an exemplary embodiment, a strip of 5.7 ounce woven carbon-fiber cloth 0.5 in. wide, 6 in. long, and 0.014 in. thick has been found to have a resistance of about 5 ohms. The power levels necessary to melt the adhesive for what is believed to be a typical book in less than 30 sec, typically 30–50 watts, can be generated by applying low voltages in the 12–24 volt range along the strip. Surface temperature measurements made on the carbon-fiber cloth strip show that at these power levels the temperature of the strip quickly rises to above 300° F. Controlling the applied voltage controls the maximum temperature. Further detail is provided in the following with reference to subsequent figures.

Furthermore, carbon has a distinctive negative temperature coefficient. Its resistance drops with increasing temperature; so a measure of the carbon-fiber strip's instantaneous resistance as it heats up allows its temperature to be calculated at any instant. Using methods well known in the art, one may use this change in resistance to actuate a feedback loop to electronically control the temperature to a predetermined maximum level.

The carbon fiber itself has an extremely high melting point, in excess of 3500° F., making it unlikely that any hot spots that might form due to small voids in the adhesive coating would cause the resistive strip to burn out during the binding process. In addition, carbon fiber has low contact resistance and does not tarnish or form insulating layers that would impede the flow of current in the region where electrodes are applied. Furthermore, carbon fiber is exceptionally strong, having a tensile strength of 500,000 psi, versus about 100,000 psi for steel. These high-strength carbon fibers, which remain embedded in the solidified adhesive layer after the binding process is complete, act like reinforcing bars in concrete to reduce the likelihood of cracking under stress. Finally, the carbon-fiber cloth acts as a flexible backing for the adhesive layer similar to the cloth backing in the binding of a conventional cloth-bound book.

The currently believed best mode of a hot-melt adhesive for the invention comprises adhesive product number HL-3165, which is manufactured for bookbinding applications (H. B. Fuller Co., St. Paul, Minn.), although this is not intended to be a limitation, as alternate bookbinding adhesives are believed also to be efficacious for the current purpose.

A first embodiment of the strip 12 of the present invention (FIG. 1) comprises a central portion 121 that is coated on both a first side 122 and a second side 123 with a hot-melt adhesive 40. In use, the first side 122 is placed against the first edge 900 of the page stack 90; the second side 123 is placed against the inside of the spine 801 of the cover 80 (see FIGS. 8A–8F).

The two opposed end portions 124,125 surrounding the central portion 121 are substantially uncoated. The length 126 of the central portion 121 is dimensioned to be approximately the length 901 of the page stack 90 desired to be bound; the width 127 of the strip 12 is dimensioned to be approximately the width 902 of the page stack 90 (see FIG. 8A). The end portions 124,125 are excisable upon completion of the adhesive melting portion of the process.

A second embodiment of the strip 22 of the present invention (FIG. 2) comprises a central portion 221 that is coated on both a first side 222 and a second side 223 with a hot-melt adhesive 40. In use, the first side 222 is placed against the first edge 900 of the page stack 90; the second side 223 is placed against the inside of the spine 801 of the cover 80.

The two opposed end portions 224,225 surrounding the central portion 221 are substantially uncoated, but each 224,225 has a metal contact 228 affixed thereto for facilitating electrical contact. The length 226 of the strip 22 is dimensioned to be approximately the length 901 of the page stack 90 desired to be bound; the width 227 of the strip 22 is dimensioned to be approximately the width 902 of the page stack 90 (see FIG. 9A).

A third embodiment of the strip 32 of the present invention (FIGS. 3A and 3B) comprises a central portion 321 that is coated on a first side 322 with a hot-melt adhesive 40. An elongated element, here a hollow tube 328 comprising, in a particular embodiment, adhesive tape, is affixed to a second side 323 of the strip 32. The tube 328 permits a paperback book to be fabricated to have the ease of page turning normally found only in cloth-bound books. In use, the first side 322 is placed against the first edge 900 of the page stack 90.

The two opposed end portions 324,325 surrounding the central portion 321 are substantially uncoated. The lengths 326 of the central portion 321 and the tube 328 are dimensioned to be approximately the length 901 of the page stack 90 desired to be bound; the width 327 of the strip 32 is dimensioned to be approximately the width 902 of the page stack 90. The end portions 324,325 are excisable upon completion of the adhesive-melting portion of the process.

A fourth embodiment of the strip 42 of the present invention (FIG. 4) comprises a central portion 421 that is coated on both a first side 422 and a second side (not shown) with a hot-melt adhesive 40. As above, in use, the second side is placed against the inside of the spine 801 of the cover 80.

The two opposed end portions 424,425 surrounding the central portion 421 are substantially uncoated. The length 426 of the strip 42 is dimensioned to be longer than the length 901 of the page stack 90 desired to be bound; the width 427 of the strip 42 is dimensioned to be wider than the width 902 of the page stack 90. In use, the first side 422 is placed against the first edge 900 of the page stack 90; the excess width 428, which may comprise, for example, 0.5 in., or 0.25 in. per side, is folded upward to bond to the front 903 and rear 904 face of the page stack 90. This embodiment provides additional binding strength and flexibility in providing nonexact strip widths and/or obviating the need for width trimming.

A fifth embodiment of the strip 52 of the present invention (FIG. 5) comprises a central portion 521 that is coated on a first side 522 with a hot-melt adhesive 40. A second side 523 of the central portion 521 is coated with adhesive 40 along the long edges 528,529 thereof. In use, the first side 522 is placed against the first edge 900 of the page stack 90; the second side 523 is placed against the inside of the spine 801 of the cover 80. In this embodiment, the second side 523 of the strip 52 is only coated along the long edges 528,529, leaving a middle section 526 free to "float" unattached to the spine 801.

A sixth embodiment 62 (FIG. 6) comprises a resistive strip 621 impregnated with adhesive 40. The strip 621 has a thin, semiporous tape 622 applied to a bottom surface 623 and contacts 624 at each end thereof. The tape 622 may comprise, for example, a masking tape, although this is not intended as a limitation.

A seventh embodiment 63 (FIG. 7) comprises a resistive strip 631 coated with adhesive 40. The strip 631 has a thin, semiporous tape 632 applied both to a lower surface 633 and upper surface 634 (under the adhesive 40) thereof. In this embodiment the adhesive 40 preferably coats the upper surface 634 of the strip 631, which provides improved flexibility and easier page turning of the finished book.

A first embodiment of the method of the present invention is illustrated in FIGS. 8A–8F. Strip 12 (FIG. 1) is illustrated for use in this method, although this is not intended as a limitation.

Figure 8A:
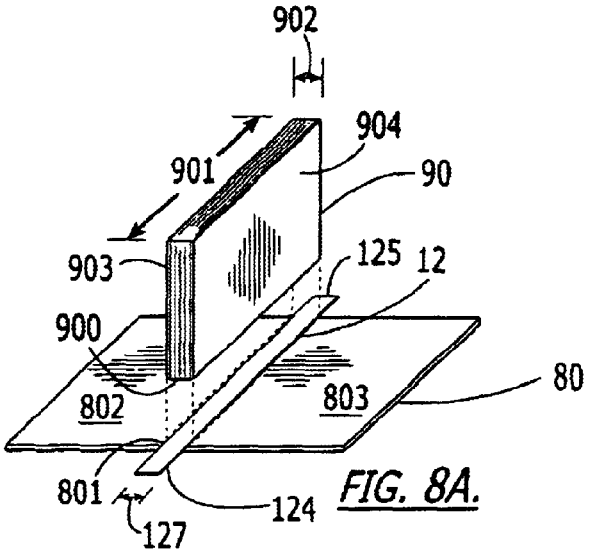
FIGS. 8A–8F illustrate a first embodiment of the method of the present invention for binding an individual book.
Figure 8B:
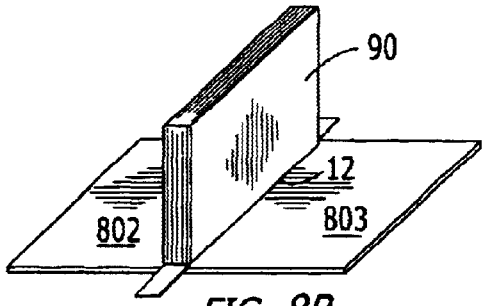
Figure 8C:
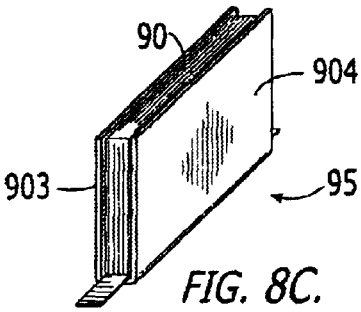
Figure 8D:
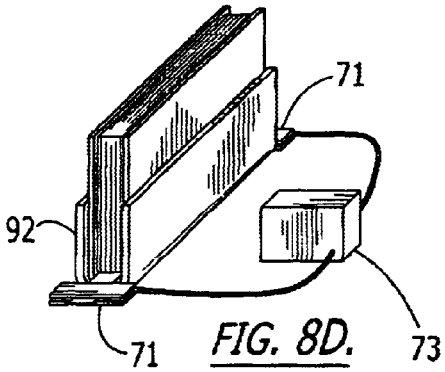
Figure 8E:
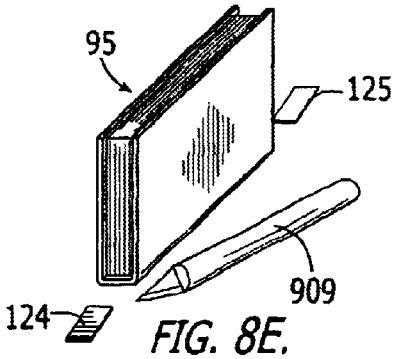

The resistive strip 12 is placed on the inside of the spine 801 of the cover sheet and the page stack 90 is positioned so as to rest on the resistive strip 12 (FIGS. 8A and 8B). The front 802 and back 803 of the cover 80 are folded upward along the front 903 and rear 904 face of the page stack 90 (FIG. 8C), and the assembled book 95 is placed into an adjustable-width U-shaped holder 92 to maintain the position of the parts during the binding process (FIG. 8D). The electrical clamps 71 are attached (FIG. 8D). Closing a switch 72 on the power supply 73 initiates the flow of a predetermined value of current through the circuit 70, causing the resistive strip 12 to rapidly heat up, melting the hot-melt adhesive 40, which wicks up into the edges of the pages 90.

After a predetermined heating time, typically 1 min, the current is shut off by a timer 74 in the power supply 73 and the adhesive 40 is allowed to solidify.

Figure 8F:
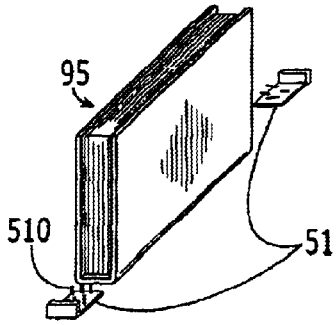

While the adhesive 40 is still molten, the exposed ends 124,125 of the resistive strip 12 are trimmed flush using a knife 909 or shears (FIG. 8E), and L-shaped trim pieces 51 are inserted in ends of the spine to cover the trimmed ends of the resistive strip 12 (FIG. 8F). In a particular embodiment, the trim pieces 51 may be made of metal, plastic, or cardboard, although these are not intended as a limitation. The trim pieces 51 may have barbs 510 or fingers, for example, that catch on the fabric of the resistive strip 12 to retain them in place after insertion.

Figure 9A:
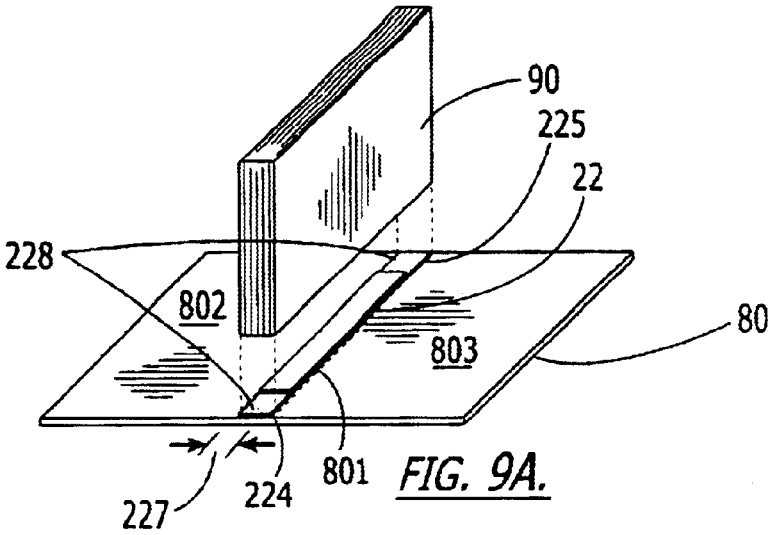
FIGS. 9A–9D illustrate a second embodiment of the method of the present invention for binding an individual book.
Figure 9B:
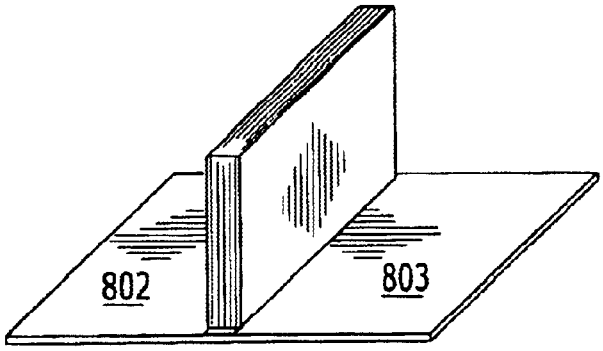
Figure 9C:
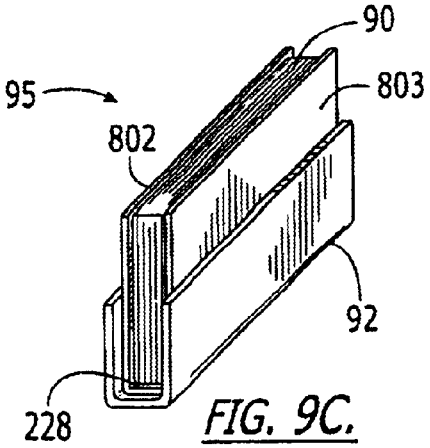

In the embodiment of the method of the invention shown in FIGS. 9A–9D, the resistive strip 22 is shown as being supplied precut to match the standard lengths of various books, with metal foil contacts 228 crimped to the ends 224,225, as illustrated in FIG. 2. The resistive strip 22 is placed on the spine area 801 of the cover sheet (FIG. 9A) and the page stack 90 is positioned so as to rest on the resistive strip 22, as before (FIG. 9B). The front 802 and back 803 of the cover 80 are folded upward along the sides of the page stack 90 and the assembled book 95 is again placed into an adjustable width U-shaped holder 92 (FIG. 9C) to maintain the position of the parts during the binding process.

Figure 9D:
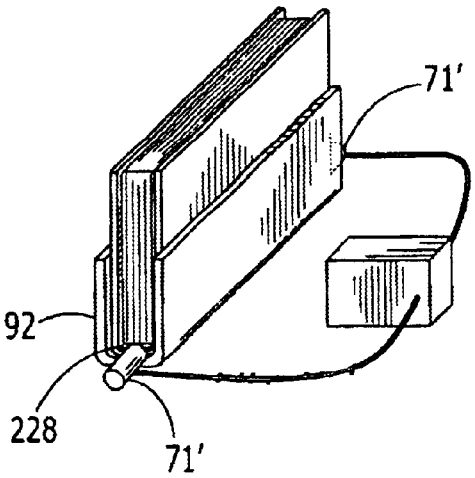

Next electrical clip leads 71' are attached to the metal contacts 228 (FIG. 9D). As before, the flow of current for a predetermined time heats the resistive strip 22, causing the adhesive 40 to melt. At the conclusion of the heating cycle, the clip leads 71' are pulled out, and the page stack 90 is pressed downward toward the spine 801 to fill any spaces previously occupied by the clip leads 71'. Since the metal contacts 228 already cover the ends 224,225 of the resistive strip 22, there is no need to insert separate trim pieces in this embodiment.

Details of exemplary clip leads 79 are illustrated in FIGS. 17A–17D. The use of clip leads in conjunction with metal foil contacts crimped or otherwise attached to the ends of the resistive strip has been found to provide an efficient low-resistance connection. There are advantages compared to the method of clamping directly to the resistive strip and having to cut the strip to length upon completion of the binding process. The metal foil also forms a neat way to finish the exposed ends of the resistive strip. For example, if brass foil is used, the ends of the spine appear to be finished with a thin gold-colored metallic thread. It is also possible to connect the clip leads to the exposed foil contacts of a finished book to reheat the binding in order to add or remove pages.

Figure 17A:
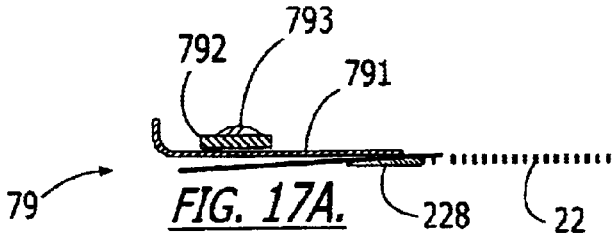
FIGS. 17A–17D illustrate the steps of applying electrical clips, with a side view (FIG. 17A) and top plan views showing the placement of a removable clip over the strip contact (FIG. 17B), the seating of the removable clip (FIG. 17C), and the removal of the removable clip (FIG. 17D).
Figure 17B:
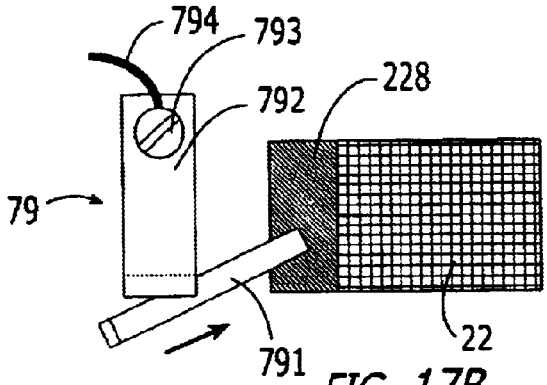
Figure 17C:
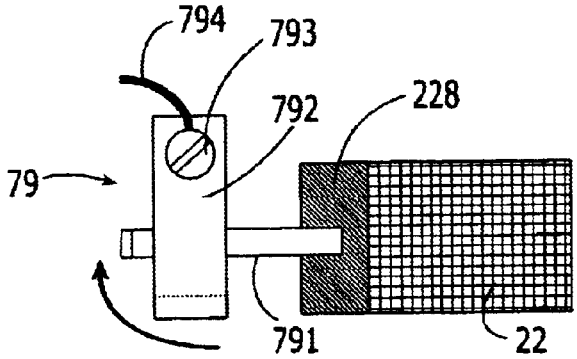
Figure 17D:
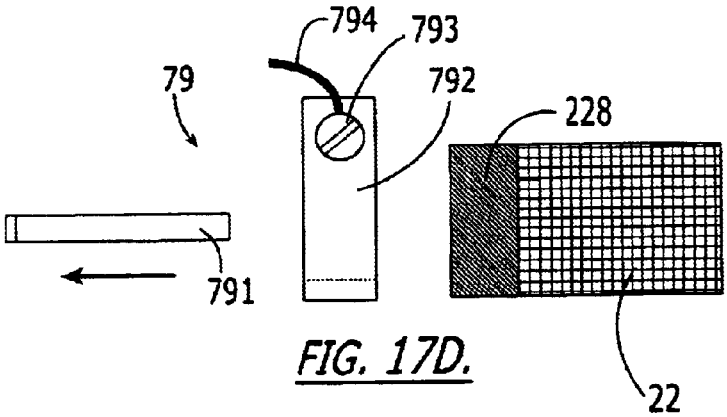

In the embodiment of FIGS. 17A–17D, the system 79 comprises a removable clip 791 and a stationary clip 792 preferably comprising a springy, highly conductive metal such as brass, although this is not intended as a limitation. The stationary clip 792, which has an upwardly extending outer end, is affixed to the base, and the removable clip 791 is positionable under the stationary clip 792 in pressing relation to the top surface of the strip contact 228 (FIG. 17A). A screw 793 holds a wire 794 extending to a power supply and also permits adjusting the force with which the removable clip 791 is held in place.

The method of using this system 79 comprises placing the removable clip 791 above the strip contact 228 (FIG. 17B) and swinging the removable clip 791 until it is tightly seated under the stationary clip 792. Next the heating current is switched on for a sufficient time to melt the adhesive 40, and then switched off. Finally, the removable clip 791 is pulled out before the adhesive 40 solidifies and can be discarded. The page stack 90 is immediately pressed downward to fill any void left by removal of the clip 791.

In this system 79 connections between the components are made by sliding metal-to-metal contact under normal forces to ensure low-resistance connection of the power supply to the resistive strip 22. The system 79 also provides sufficient mechanical force to hold the strip 22 and cover in position at the beginning of the binding process (see FIG. 15C). The removable clip 791 is inexpensive and thus suitable for disposal after a single use, thus avoiding potential problems from repeated use and adhesive buildup. The upwardly extending outer end of the removable clip 791 facilitates grasping during positioning and removal, and also prevents its being inserted too far into the book spine.

Figure 13A:
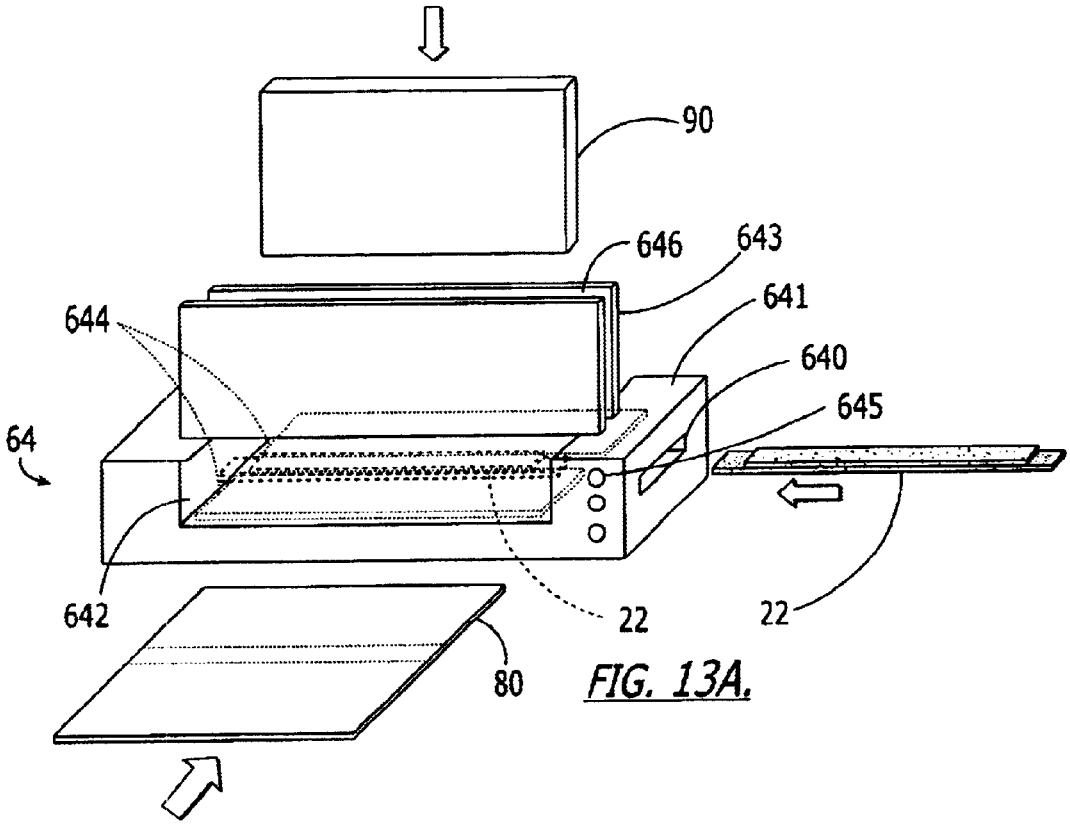
FIGS. 13A and 13B are side perspective illustrations of embodiments of a binding machine for manual feed (FIG. 13A) and automatic roll feed (FIG. 13B).
Figure 13B:
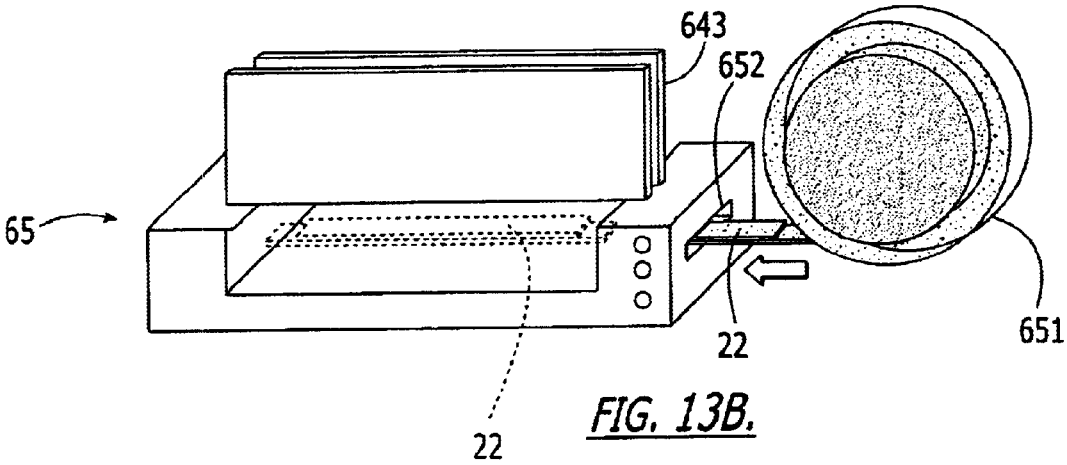

In two alternate embodiments, a binding machine 64,65 is provided for feeding any of the strips described above into position for application to a page stack 90. In FIG. 13A manual feed of a strip 22 is performed through a slot 640 in a housing 641 of the binding machine 64, which leads into a well 642 in the housing 641. A pair of opposed, spaced-apart page clamps 643 are positioned above the well 642 for receiving the page stack 90 into a gap 646 therebetween. A cover 80 is slidable under the strip 22 at the bottom of the well 642 atop a pair of cover folding clamps 644. Controls 645 are positioned on the outside of the housing 641 and are connected for controlling the machine's functions.

A second binding machine 65 (FIG. 13B) has similar components, except that the strip 22 is fed from a roll 651 adapted to feed strips 22 automatically into the slot 652.

Figure 14:
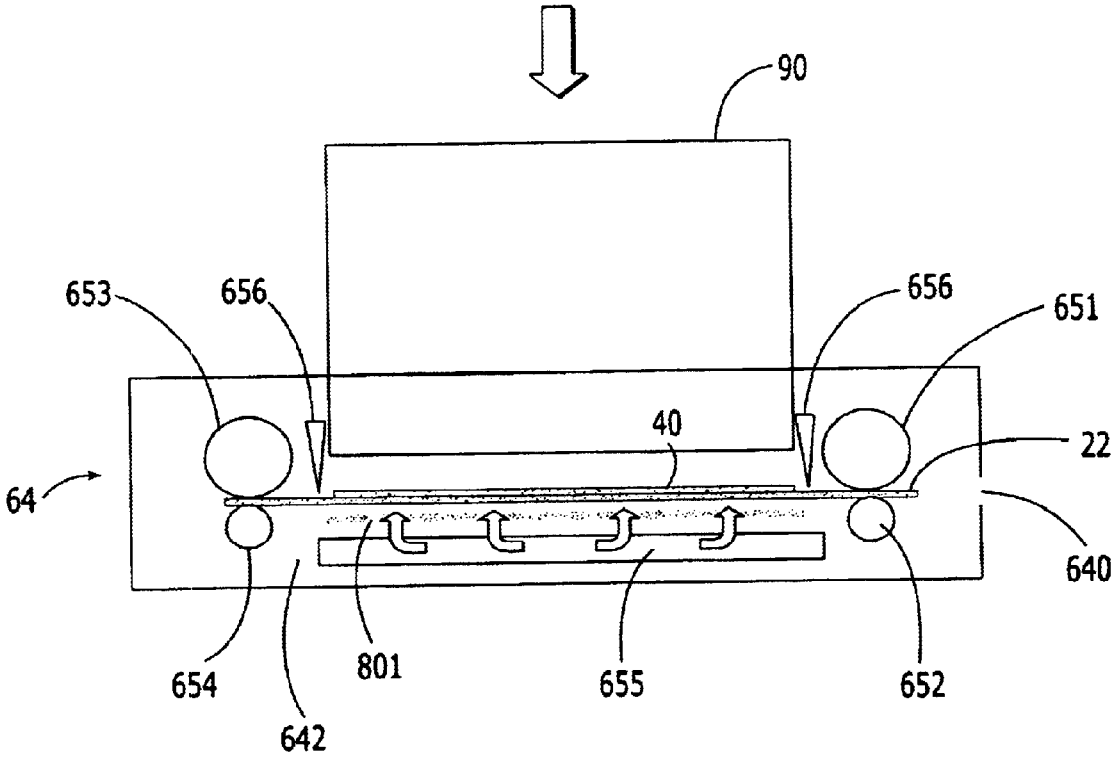
FIG. 14 is a side cross-sectional view of a binding machine showing the feed drive and cooling systems.

In FIG. 14 is illustrated schematically feed drive and cooling systems for the binding machine 64. When the strip 22 is inserted into the slot 640, the strip 22 passes between a first pinch roller 651 and capstan 652 pair adjacent the slot 640 and proceeds through the well 642 to a second pinch roller 653 and capstan 654 pair and held there above the cover spine 801. The capstans 652,654 also comprise electrical contacts for melting the adhesive 40, after which cooling air is provided from a blower 655 during the cooling cycle following melting the adhesive 40. Next a pair of cutters 656, positioned above the strip 22 adjacent the page stack 90, are activated to cut the strip 22 closely adjacent the page stack edges.

Figure 15A:
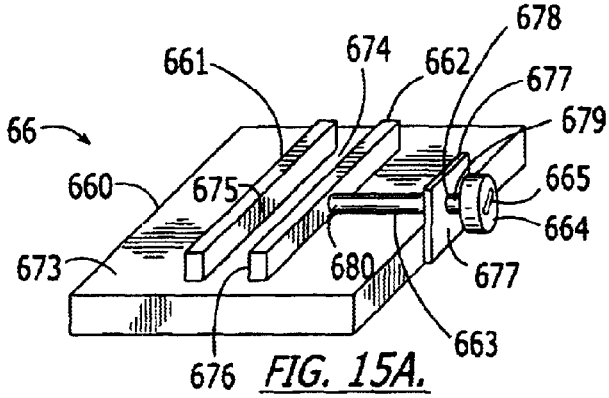

A manual clamping device 66 and method of use are illustrated in FIGS. 15A–15H. The clamping device 66 comprises a generally planar base 660 (FIG. 15A). Affixed atop the base 660 are a first, fixed jaw 661 and a second, movable jaw 662 that is movable across the top surface 673 of the base toward the fixed jaw 661 to change a gap width 674 between the respective inner surfaces 675,676 thereof so that the inner surfaces 675,676 remain essentially parallel.

A plate 677 that has a threaded bore 678 therethrough is affixed to the base 660 with the bore 678 substantially parallel to and above the base's top surface 673. A lead screw 663 is extendable through the bore 678 and has a knob 664 at a first end 679 that is adapted to turn the screw 663. A second end 680 is abuttable against an outer surface 669 of the movable jaw 662. The knob 664 of the screw 663 has a groove 665 therein for mating with a means for rotating, such as an electric screwdriver.

Figure 15B:
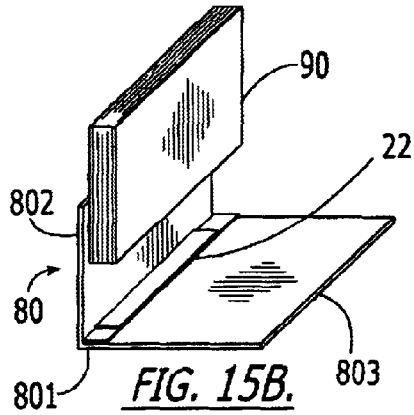
Figure 15C:
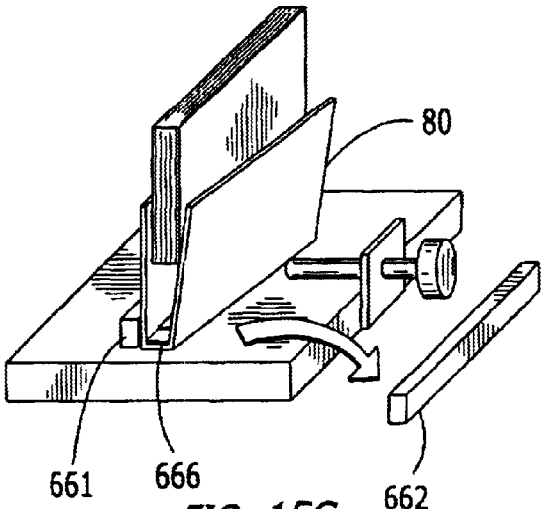

In use, a strip 22 is placed onto the spine 801 of a cover 80, and a first leaf 802 of the cover 80 is folded upward along a prescored line (FIG. 15B). The page stack 90 is lowered onto the strip 22, and a score is made along the exposed edge of the strip 22 to facilitate a subsequent folding of the second cover leaf 803. The assembled book components are placed against the fixed jaw 661 (FIG. 15C), and spring-loaded removable electrical clips 791 are placed on the contacts 228 of the strip 22. The removable clips 791 also are adapted to provide sufficient downward force to hold the strip 22 and cover 80 in place against the fixed jaw 661 during the process. If desired, the movable jaw 662 may be moved farther from the fixed jaw 661 or removed from the base 660 to provide sufficient clearance for the cover 80.

Figure 15D:
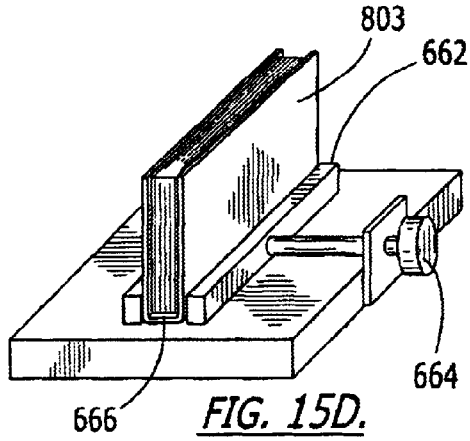

Next the second cover leaf 803 is folded upward, the movable jaw 662 is pushed against it, electrical current is applied to the removable clips 791 to melt the adhesive 40, and clamping pressure is applied via the knob 664 (FIG. 15D). Testing has shown that, in an exemplary case, approximately 15 sec is sufficient to melt the adhesive 40. Preferably downward pressure is applied with a scrubbing motion (FIG. 15H) to the top of the page stack 90 to ensure complete wetting of the page edges with the melted adhesive 40. After a predetermined time, generally within 60 sec, the current is switched off, the removable clips 791 are withdrawn, and downward pressure to the page stack 90 is continued while the knob 664 is tightened to apply full clamping pressure. The process is complete, and the book is set aside for another predetermined time, typically several minutes, while the adhesive 40 solidifies.

Figure 15E:
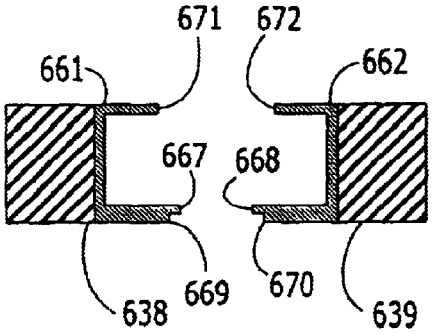
Figure 15F:
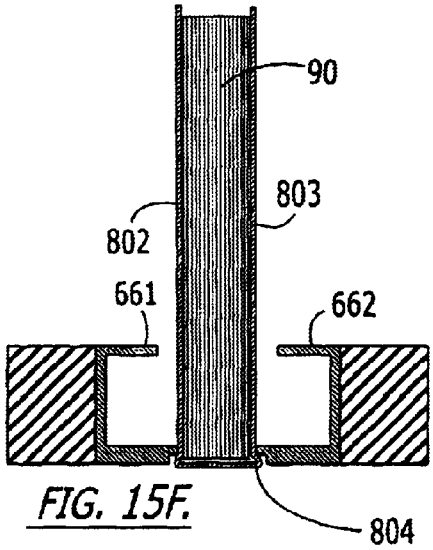

A detailed cross-sectional view of the clamping jaws 661,662 is shown in FIGS. 15E and 15F. Each jaw 661,662 comprises a generally "C"-shaped member having a pressure application edge 667,668 positioned above the base's top surface 673, each in turn integral with a recessed containment edge 669,670 therebeneath and above the arms' bottom surfaces 638,639. In a particular embodiment, the pressure application edges 667,668 are positioned approximately 1/8 in. above the base's top surface 673. This provides for a flared cover adjacent the spine 801. The containment edges 669,670 limit the width of the flare on each side to a predetermined amount, here 3/32 in. beyond the plane of the outer surface of the cover 80. The top of the "C" comprises a pair of supporting edges 671,672, which prevent the book from tipping during scrubbing (FIG. 15H), here within 1/16 in.

An advantage of the flared cover area 804 of the bound book (FIG. 15F) is that it allows the use of a flat resistive strip 22 that is wider than the thickness of the page stack 90. This accommodates alignment variations during assembly and ensures that the outermost pages of the page stack receive adequate wetting with melted adhesive 40. In an alternate embodiment the resistive strip 42 is formed into a "U"-shaped cross section extending upward along the covers 802,803. It has been found that a flat resistive strip provides a more flexible binding with greater ease of page turning than that produced by the same resistive strip formed into a "U"-shaped cross section. A flat strip also has a better appearance inside the cover of the finished book, since there is no exposed adhesive or resistive strip material visible in the spine area when the book is opened. It may be contemplated to manufacture the flat strips in a few predetermined standard widths, rather than needing to custom trim the width of each strip to match the thickness of each page stack 90. Further, a flat strip is easier to manufacture, since it can be processed in large rolls and then cut to size.

In addition to accommodating a wider strip, the flared cover offers other benefits. This arrangement leaves a small void (FIG. 15F) that can accept excess adhesive that would otherwise be squeezed out at the ends of the spine or up along the inside surface of the cover, either of which would be unsightly. The high local pressure produced by the clamping jaws just above the flared area further inhibits excess adhesive flow up along the inside of the cover. The height of the flare is small, typically only approximately 3/32 in. above the plane of the cover, for example, giving books produced by the method of the present invention a distinctive, crisp styling. Further, the flare offers a functional advantage by making the book easier to grasp when removing it from a bookshelf, for example.

The open construction of the jaws 661,662 permits a freer airflow than would solid jaws during the cooling phase, which speeds up the binding process. If the jaws 661,662 comprise a heat-conducting material such as aluminum, the cooling phase would be further hastened.

An advantage of the present invention is the ability to use a thick layer of adhesive 40 to a strip 22. Since alignment of pages may not be perfect in such a "manual" method, an uneven edge may be presented to the strip 22 for binding. Experiments conducted during the reduction to practice of the present invention have indicated that a thin layer of adhesive (approximately 10–20 mils) may be insufficient to achieve complete wetting of the page edges 900, which may cause loss of pages after binding. However, if a thicker layer 401 is used (approximately 60–70 mils; FIG. 15G), all pages will be adequately bound.

A potentially negative aspect of using a relatively thick layer of adhesive to accommodate irregular pages is that the resulting spine will have greater stiffness, making page turning more difficult. The present invention provides alternate adhesive layer patterns that have a noncontinuous, open configuration for enhancing spine flexibility and facilitation of page turning.

A first subembodiment 22' of an adhesive pattern (FIGS. 16A,16B), a relatively thick layer of adhesive is applied in a plurality of bands 402 extending across the strip 22' from a first side edge 211 to a second side edge 212. Preferably the outermost bands 403 adjacent the end portions 224,225 are thicker than those 402 in the central region. Exemplary relative thicknesses are 80 mil for height 407 and 60 mil for height 408, although these are not intended as limitation. In addition, the outermost bands 403 may have a greater height 407 than the height 408 of the bands 402 in the central region. These outermost bands 403 provide enhanced holding power at the point at which a page is susceptible to be torn out. The open areas between the bands 402,403 provide enhanced spine flexibility.

A second subembodiment 22" of an adhesive pattern (FIGS. 16C,16D), believed to be a most preferred embodiment, comprises a "ladderlike" pattern. The "rungs" of the ladder, which extend across the strip 22" between the side edges 224,225, comprise relatively thick (40–70 mils) adhesive bands 404. The "side rails" 405, which are positioned along the side edges 211,212 of the strip 22", provide bonding along the edges of the outermost pages, those that are most likely to be torn out. The side rails 405 also provide continuous lines of adhesive at the strip edges 211,212 for bonding with the inside of the cover. Further, the side rails 405 achieve an "open" type of spine such as those in cloth-bound books, providing an analogous ease of page turning. Finally, the method of manufacturing this type of strip 22" is believed to be simpler, since adhesive 40 only need be deposited on the strip's top (first) surface 222.

Another feature of the present invention is a page stack carrier 68 to help align loose pages prior to binding. The carrier 68 is adapted to jog the pages into alignment and hold them securely in alignment prior to assembly of the book components in the clamping device and also during application of downward pressure and "scrubbing."

Figure 18C:
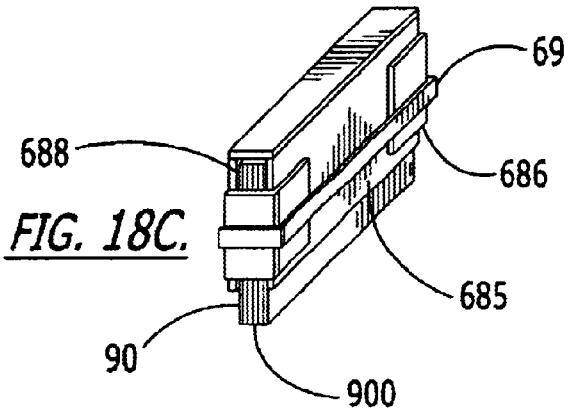
FIGS. 18A–18C illustrate the details of the page stack carrier, with a top plan view of the carrier before folding (FIG. 18A) and side top perspective views of the application of the carrier (FIG. 18B) and the page stack in the carrier (FIG. 18C).
Figure 18A:
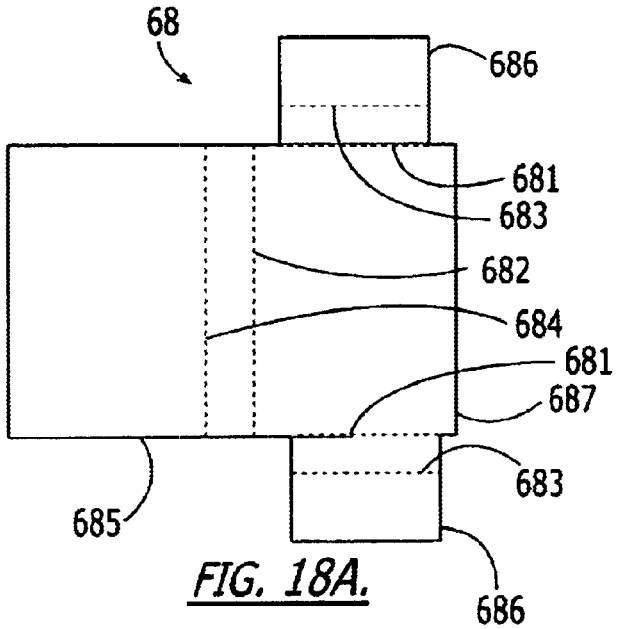
Figure 18B:
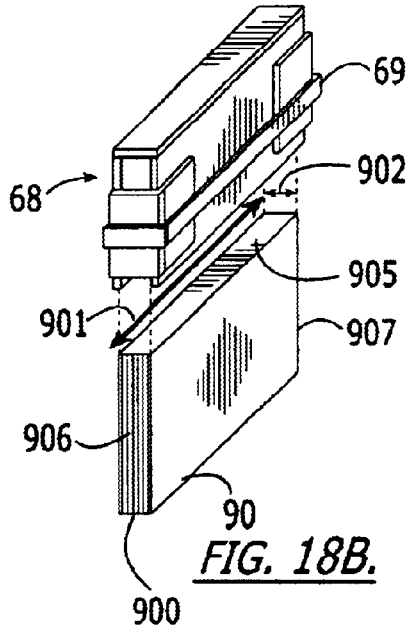

The carrier 68 comprises a single sheet of, for example, thin cardboard of the thickness of manila file folders (FIG. 18A). The sheet 68 comprises a generally "T"-shaped element comprising a base section 685 and a pair of cross bar sections 686, the cross bar sections 686 slightly recessed from the "top" 687 of the base section 685. The sheet 68 has a plurality of prescored lines therein to facilitate folding. A first pair of scores 681 extend collinearly with the sides of the base section 685 to separate the cross-bars 686 of the "T" therefrom, a distance therebetween commensurate with a length 901 of the page stack 90. A third prescored line 682 extends across the base section 685 in spaced relation from the cross bar sections 686.

Three scores should be made by the user: a second pair of scores 683 farther out along the cross bar parallel to the first pair 681 and separated therefrom by the width 902 of the page stack 90. The third user-made score 684 should be made parallel to the base line 682 and farther away from the cross bar sections 686 and separated therefrom by the width 902 of the page stack 90 to surround the top 907 and the bottom 906 edges of the page stack 90.

As assembled (FIGS. 18B and 18C) the carrier 68 may be held together, for example, by an elastic member 69. The recesses permit the formation of a window 688 to permit the user to check the alignment of the page stack 90.

A frequent criticism of perfect bound books is the stiffness of the binding, requiring much more effort to open to a page than with a cloth-bound book. This occurs in part because in a perfect binding the adhesive cements the edges of the pages directly to the rigid spine of the cardboard cover, as shown in FIG. 8F. In many cloth-bound books, a lightweight flexible cloth-backed inner binding is attached to the heavier outer cloth spine only along its long edges. This so-called "hollow binding construction" can be viewed by opening the covers of a cloth-bound book and observing how the top of the spine opens to reveal a space between the flexible inner binding and the heavier cloth outer binding.

Figure 10:
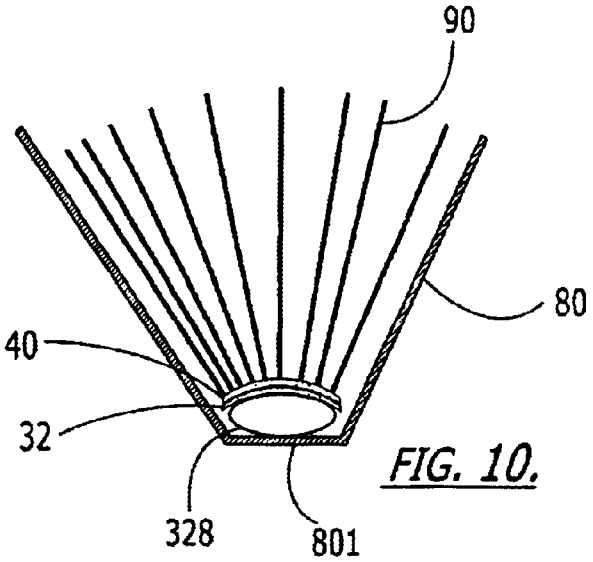
FIG. 10 is an end view of a book bound using the strip embodiment of FIG. 3.

The embodiment of the present invention illustrated in FIG. 3 and in more detail in FIG. 10 provides a more flexible binding than conventional perfect bound volumes by adding a hollow tube 328 comprising, for example, strong adhesive tape such as 3M Scotch brand mailing tape (3M, 3M Center, St. Paul, Minn. 55144-1000) between the resistive strip 32 and the substantially rigid spine 801 of the cover 80 to allow the resistive strip 32 to "float" relative to the spine 801.

Another limitation of conventional perfect bound books is that the spine and the face of the page stack 90 must be flat. Many expensive cloth-and leather-bound volumes are designed to have convex spines and concave page stack faces. With perfect binding, however, the face of the page stack 90 is always flat because the sides of the page stack 90 are trimmed with a guillotine cutter after the book is bound to align the page edges and remove any adhesive that has oozed from the ends of the spine.

Figure 11:
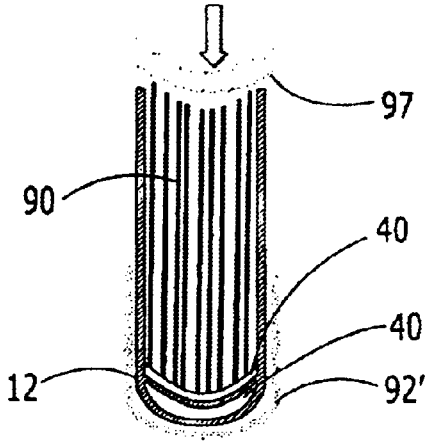
FIG. 11 is an end view of a book bound using a concave holder.

Referring now to FIG. 11, an embodiment is shown of the present invention for forming a convex spine and concave face on the page stack 90 by pressing the book into a U-shaped holder 92' with a concave bottom while the adhesive 40 is still molten. Pressure may be applied, for example, with a concave shaping element 97. Thus the present invention provides an optional styling advantage for book designers not available with conventional perfect binding.

Figure 12:
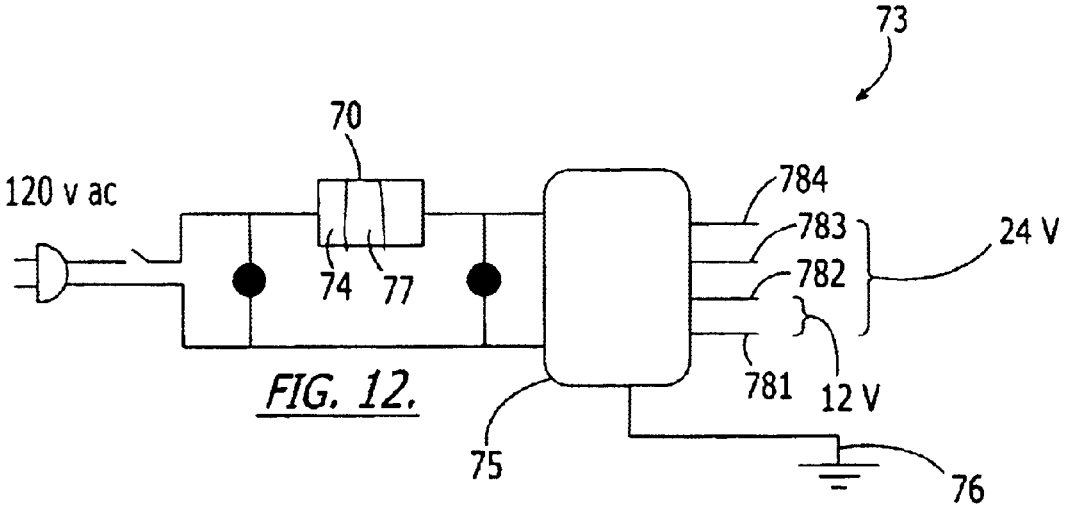
FIG. 12 is an exemplary circuit diagram for a power supply usable in the book binding system and method.

A schematic is shown in FIG. 12 for a basic circuit containing a power supply 73 in accordance with the present invention. As noted above, laboratory tests have shown that for a typical book, about 40 watts of power into the carbon-fiber cloth resistive strip is required to melt the adhesive in less than 30 sec. Laboratory testing also shows that alternating current causes heating of the resistive strip and melting of the adhesive as effectively as direct current, as would be expected from theory.

What is believed at present to be the simplest and least costly power supply is a step-down transformer that converts 120 volts from a power line to a safer value of 12–24 volts with sufficient current, while also providing electrical isolation from the power line to minimize shock hazards. A control module 70 containing an adjustable timer 74 such as those well known in the art is used to set the duration of the heating cycle, typically about 1 min. Interlocks on a protective cover (not shown) may be used to prevent voltage from being applied to the clamps 71 or clip leads 71' until the protective cover is closed, as additional protection against possible shock hazard. Furthermore, the frame 76 of the transformer 75 is grounded for protection of the operator in the event of a voltage breakdown within the transformer 75, and a circuit breaker 77 is included in either the primary or the secondary circuit of the transformer 75 to protect the transformer 75 from overheating in the event that the output connections 781–784 are accidentally shorted together.

The value of current needed to melt the adhesive 40 in less than 30 sec is a function of the width of the resistive strip, which in turn is a function of the number of pages in the stack 90. Consider first a book with a fixed spine length, say 7 in. Laboratory tests show that for a 0.5-in.-wide resistive strip, which corresponds to a book of approximately 200 pages, a current of about 2.5 amperes rms is required to melt the adhesive 40 in less than 30 sec. Thus the optimal current density is about 5 amperes per inch of width. A 0.5-in.-wide strip has a measured resistance of about 1 ohm per linear inch, or 7 ohms for the 7-in.-long spine. For a 1-in.-wide strip, the resistance drops to 0.5 ohm per linear inch, or 3.5 ohms for the 7-in. spine. The rate of heating is proportional to the current density in amperes per inch of width. For a given spine length, such as 7 in., it follows that if a constant voltage source is used, the current density in amperes per inch of width remains constant. As the width increases, the resistance drops proportionally, the current increases proportionally, and the current density remains constant. Therefore, for a fixed spine length such as 7 in., a constant voltage source such as the transformer 75 described above provides automatic compensation for variations in the number of pages of the book to maintain the optimal current density of 5 amperes per inch of width needed for rapid heating. To bind books up to 1.5 in. thick, the transformer should be capable of providing current up to 7.5 amperes.

If the length of the spine is now increased from 7 to 11 in., more voltage is needed to maintain the required current density for the optimal heating rate. To produce the required 2.5 amperes in a 0.5-in.-wide strip 7 in. long having a resistance of 7 ohms, Ohm's law shows that the applied voltage must be about 17 volts. If the length of the 0.5-in.-wide strip is increased to 11 in., the largest size book normally encountered, the required voltage increases to just over 24 volts. Therefore, it is necessary to offer some adjustment in voltage to accommodate books ranging in size from 4×7-in. paperback novels up to 8 ½×11-in. telephone books. As shown in FIG. 12, including a plurality of taps 781–784 on the secondary of the transformer 75 provides voltages over the required range. If necessary, fine adjustments in the heating cycle can be made by lengthening or shortening the heating time.

While tests show that a simple power transformer 75 is a satisfactory power supply for the present invention, a direct current supply capable of supplying the same values of voltage and current as those described above could be used.

As noted previously, carbon has a distinctive negative temperature coefficient. Its resistance drops with increasing temperature; so a measure of the carbon-fiber strip's instantaneous resistance as it heats up allows its temperature to be calculated at any instant. Using methods well known in the art, one may use this change in resistance to actuate a feedback loop in a dc supply to electronically control the maximum temperature to a preset level.

Although much of the exposition of the present invention has been presented in terms of binding paperback books, it is obvious that the same system and method apply equally well to the binding of cloth- and leather-bound books.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A system for binding a stack of pages along an edge thereof to form a book, the system comprising:

an elongated flexible strip having opposed ends and an electrical resistivity between the ends, the strip having an adhesive with a predetermined melting temperature along at least a portion of a first side thereof, the strip and the one side dimensioned to substantially cover a first edge of a stack of pages to be bound;

an elongated generally tubular element extendable between a second side of the strip opposed to the first side and a spine of a cover; and means for passing an electrical current along the strip between the ends, the current sufficient to create sufficient heat in the strip to achieve a temperature at least as great as the melting temperature in order to melt the adhesive and thereby bind the stack of pages together along the first edge.

2. The system recited in claim 1, wherein the tubular element has a convex shape along a first side adjacent the strip second side, for permitting the strip to remain unaffixed to the cover along at least a generally central portion thereof, for facilitating page turning.

3. The system recited in claim 1, wherein the portion having the adhesive thereon comprises an axially central portion having a width greater than a width of the stack for application to the first edge of the stack and along an edge of each of a front and a rear face of the stack.

4. The system recited in claim 1, wherein the strip further has a second side opposed to the first side, the second side having a central portion and edges along an axial length thereof, a section along each second side edge coated with the adhesive.

5. The system recited in claim 1, wherein the strip comprises a flexible strip comprising a material selected from the group consisting of a metal foil, a conductive strip applied to a substrate, carbon-fiber, and metal mesh.

6. The system recited in claim 1, wherein:

the strip has a first and a second side edge, each extending between the opposed ends; and the adhesive comprises a plurality of bands of adhesive, the bands extending between the first and the second side edge.

7. The system recited in claim 1, further comprising a generally "U"-shaped holder having a gap between two arms thereof, the gap having a width sufficient to admit the page stack and the cover in surrounding relation to the page stack.

8. The system recited in claim 5, wherein the adhesive comprises a hot-melt adhesive applicable to the strip in solid form.

9. The system recited in claim 6, wherein the bands have a thickness generally parallel to the first and the second side edges, and wherein an outermost band adjacent each end has a thickness greater than a thickness of the bands interior thereto.

10. The system recited in claim 6, wherein the adhesive further comprises a strip of adhesive extending generally adjacent each side edge.

11. The system recited in claim 10, wherein the bands have a thickness generally parallel to the first and the second side edges, and wherein an outermost band adjacent each end has a thickness greater than a thickness of the bands interior thereto.

12. The system recited in claim 7, wherein the holder comprises:

a generally planar base;

a first jaw affixed to a top surface of the base;

a second jaw movable across to the base top surface and having an inner surface generally parallel to an inner surface of the first jaw; and means for moving the second jaw and for retaining the second jaw at a desired gap width from the first jaw.

13. The system recited in claim 7, further comprising means for supporting the page stack in alignment for entry into the cover.

14. The system recited in claim 12, wherein the moving and the retaining means comprises:

a plate having a threaded bore therethrough, the plate affixed to the base with the bore substantially parallel to and above the base top surface; and a lead screw extendable through the bore and having a knob at a first end adapted to turn the screw and a second end positionable in movement-producing relation against the movable jaw.

15. The system recited in claim 12, wherein the first and the second jaw inner surfaces each comprise a generally "C"-shaped cross section, having an upper, inwardly extending supporting edge and a lower, inwardly extending pressure-application edge positioned in spaced relation above the base top surface, a gap between the pressure-application edges smaller than a gap between the supporting edges.

16. The system recited in claim 15, wherein the first and the second jaw inner surfaces each further have an inwardly extending containment edge positioned between the pressure-application edge and a bottom surface of the first and the second jaw, a gap between the containment edges larger than the gap between the pressure-application edges.

17. A system for binding a stack of pages along an edge thereof to form a book, the system comprising:

an elongated strip having opposed ends and an electrical resistivity between the ends, the strip having an adhesive with a predetermined melting temperature along at least a portion of a first side thereof, the strip and the one side dimensioned to substantially cover a first edge of a stack of pages to be bound;

means for passing an electrical current along the strip between the ends, the current sufficient to create sufficient heat in the strip to achieve a temperature at least as great as the melting temperature in order to melt the adhesive and thereby bind the stack of pages together along the first edge;

a generally "U"-shaped holder having a gap between two arms thereof, the gap having a width sufficient to admit the page stack and the cover in surrounding relation to the page stack;

a page stack carrier for supporting the page stack in alignment for entry into the cover, the page stack carrier comprising an enclosure dimensioned for holding the page stack therewithin, the first edge of the stack protruding therefrom.

18. The system recited in claim 17, wherein the carrier comprises a generally "T"-shaped substantially flat sheet of formable material having:

a generally rectangular base section dimensioned for extending partially around a front page of the page stack, a second edge of the page stack opposed to the first edge, and a rear page of the page stack, leaving a sufficient portion of the page stack first edge exposed for binding; and a pair of generally rectangular cross bar sections each extending generally perpendicularly outwardly one from each side edge and adjacent a top edge of the base section, the cross bar sections dimensioned for wrapping around a top and a bottom edge of the page stack extending between the first and the second edges thereof.

19. The system recited in claim 17, wherein the electrical current introducing means comprises a power supply and a switch in electrical connection between the power supply and the strip ends, the switch having an "on" position for activating the power supply and an "off" position for deactivating the power supply.

20. The system recited in claim 18, further comprising means for holding the carrier in surrounding relation to the page stack.

21. The system recited in claim 18, wherein the sheet comprises a plurality of scores therein for facilitating folding along at least some of the first, the second, the top, and the bottom page stack edges.

22. The system recited in claim 19, further comprising means for timing a predetermined period from the switch being turned to the "on" position for activation of the power supply and means for turning the switch to the "off" position upon reaching the predetermined period of activation.

23. The system recited in claim 22, wherein the timing means further comprises means for setting the predetermined time.

24. A system for binding a stack of pages along a first edge thereof to form a book, the system comprising:

an adhesive;

an elongated strip coated on at least a portion a first side with the adhesive;

a generally "U"-shaped holder having a width sufficient to admit the page stack and a cover therefor in surrounding relation to the page stack, the strip positionable along an interior of a spine of the cover; and a page stack carrier for supporting the page stack in alignment for entry into the cover, the page stack first edge positionable against the strip, the page stack carrier comprising an enclosure dimensioned for holding the page stack therewithin, the first edge of the stack protruding therefrom.

25. The system recited in claim 24, wherein the carrier comprises a generally "T"-shaped substantially flat sheet of formable material having:

a generally rectangular base section dimensioned for extending partially around a front page of the page stack, a second edge opposed tote first edge, and a rear page of the page stack, leaving a sufficient portion of the page stack first edge exposed for binding; and a pair of generally rectangular cross bar sections each extending generally perpendicularly outwardly one from each side edge and adjacent a top edge of the base section, the cross bar sections dimensioned for wrapping around a top and a bottom edge of the page stack extending between the first and the second edges thereof.

26. The system recited in claim 25, further comprising means for holding the carrier in surrounding relation to the page stack.

27. The system recited in claim 26, wherein the sheet comprises a plurality of scores therein for facilitating folding along at least some of the first the second, the top, and the bottom page stack edges.

28. A device for binding a stack of pages along a first edge thereof in a cover to form a book, the device comprising:

a housing having a well extending thereinto and a slot leading into the well from outside the housing, the well adapted for supporting the cover, the slot adapted to admit an electrically resistive strip onto a spine region of the cover, the strip having a heat-meltable adhesive coated on at least a portion thereof;

a pair of spaced-apart clamps affixed to the housing, having a gap therebetween in communication with the well, the clamps having substantially planar facing surfaces positioned to admit the page stack therebetween and to guide the page stack into the well atop the strip; and means for introducing an electrical current to pass along the strip between ends thereof, the current and the resistivity sufficient to create sufficient heat in the strip to melt the adhesive.

29. The device recited in claim 28, further comprising means for trip automatically into the slot.

30. The device recited in claim 28, further comprising means for strip following adhesive melting.

31. The device recited in claim 28, further comprising means for trimming the strip ends closely adjacent ends of the page stack first edge.

* * * * *